US006871532B2

(12) United States Patent
Zazovsky

(10) Patent No.: US 6,871,532 B2
(45) Date of Patent: Mar. 29, 2005

(54) METHOD AND APPARATUS FOR PORE PRESSURE MONITORING

(75) Inventor: Alexander Zazovsky, Houston, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/262,242

(22) Filed: Sep. 30, 2002

(65) Prior Publication Data

US 2003/0084715 A1 May 8, 2003

(30) Foreign Application Priority Data

Oct. 12, 2001 (GB) ..... 0124477

(51) Int. Cl.[7] ..... E21B 49/00

(52) U.S. Cl. ..... 73/152.05; 73/152.05; 73/152.25; 73/152.03; 73/152.01

(58) Field of Search ..... 73/152.05, 152.25, 73/152.03, 152.01

(56) References Cited

U.S. PATENT DOCUMENTS

| | | | | | |
|---|---|---|---|---|---|
| 3,934,468 | A | * | 1/1976 | Brieger | 73/152.25 |
| 4,570,480 | A | | 2/1986 | Fontenot et al. | |
| 4,787,447 | A | * | 11/1988 | Christensen | 166/169 |
| 4,799,382 | A | * | 1/1989 | Sprunt et al. | 73/152.07 |
| 4,936,139 | A | * | 6/1990 | Zimmerman et al. | 73/152.26 |
| 4,961,343 | A | * | 10/1990 | Boone | 73/152.03 |
| 5,285,692 | A | * | 2/1994 | Steiger et al. | 73/866 |
| 6,070,662 | A | | 6/2000 | Ciglenec et al. | |
| 6,412,575 | B1 | * | 7/2002 | Harrigan et al. | 175/20 |
| 6,453,727 | B1 | | 9/2002 | Lenormand et al. | |

FOREIGN PATENT DOCUMENTS

| | | | | |
|---|---|---|---|---|
| EP | 0095837 A2 | * | 12/1983 | E21B/49/08 |
| EP | 1045113 A1 | * | 10/2000 | E21B/47/01 |
| GB | 2 272 525 A | | 5/1994 | |
| WO | WO 9612088 A1 | * | 4/1996 | E21B/49/08 |
| WO | WO 9708424 A1 | * | 3/1997 | E21B/17/20 |

OTHER PUBLICATIONS

Conduction of heat in solids, H S Carslaw, J C Jaeger, Oxford at the Clarendon Press, 2nd Edition, 1959, p334–339.

Petroleum related rock mechanics, E Fjaer, R M Holt, P Horsrud, A M Raaen, R Risnes, Development in Petroleum Science, vol. 33, Elsevier, 1992, p109–119.

* cited by examiner

*Primary Examiner*—Hezron Williams
*Assistant Examiner*—André K. Jackson
(74) *Attorney, Agent, or Firm*—William L. Wang; Tim W. Curington; William B. Batzer

(57) ABSTRACT

A method of monitoring pore pressure, comprises the steps of:

(a) providing downhole in a well a sealable container, (b) sealing in the container a sample of fluid at a baseline pressure and a sample of a formation having an initial pore pressure, (c) measuring the change in pressure of the fluid sample, the pressure of the fluid sample and the pore pressure of the formation sample sealed in the container tending to equalize over time, and (d) estimating the initial pore pressure relative to the baseline pressure from the measured change in fluid sample pressure.

15 Claims, 4 Drawing Sheets

METHOD AND APPARATUS FOR PORE PRESSURE MONITORING

FIELD OF THE INVENTION

The present invention relates to a method and an apparatus for monitoring pore pressures, and in particular for monitoring rock formation pore pressures in hydrocarbon wells.

BACKGROUND TO THE INVENTION

Determination of formation pressure while drilling has been a challenge to the oil and gas industry. Knowledge of formation pore pressure variation ahead of the drill bit would allow a driller to control the mud weight and the overbalance pressure (i.e. the difference between the bottom hole mud pressure and the formation pore pressure) in an optimal way, reducing permeability damage without compromising the safety of drilling operations.

In many cases, however, accurate knowledge of the formation pressure is not so important as knowing whether it is above or below the downhole mud pressure. This information becomes crucially important when drilling through cover rock with very low permeability (e.g. shale or clay) separating high permeability formations, as the low permeability rock can sustain a high pore pressure gradient disguising a large differential between the pore pressures of the high permeability formations. If the mud pressure is not adjusted in time, such a differential can lead to a potentially hazardous kick or a circulation loss when the wellbore is extended to traverse the cover rock and re-enter high permeability formation.

Thus early indications of increases in pore pressure gradient (i.e. while drilling is restricted to the cover rock) could allow the driller to take appropriate action to reduce or eliminate the likelihood of kicks or circulation losses.

A conventional procedure for determining formation pore pressures is based on the hydrodynamic properties of the formation. In the procedure, a specially designed tool enters the well on a cable or wireline, engages with the formation forming the wall of the wellbore, and draws in an amount of pore fluid. The pore pressure can then be determined from the rate at which pore fluid enters the tool, taking due account of factors such as the pressure diffusivity within the formation, and the quality of filter cake created while drilling.

However, because of the common practice of drilling overbalance, the pore pressure near the wellbore tends to be higher than the formation pore pressure at a distance from the wellbore. Thus drilling is usually suspended for a period prior to testing to allow the near-wellbore pore pressure to recover (drilling in any event needs to be interrupted to allow the tool to enter the well on the wireline). Unfortunately, for low permeability formations, which take significant times to recover, the testing time then becomes unacceptably long.

Other conventional methods for formation pore pressure determination are based on empirical relationships between the formation pore pressure and porosity, in situ stresses, lithology and mineral composition of rock. These relationships are usually established by making correlations with log and seismic data from previously drilled wellbores, and may therefore be available only when the drilling of similar wells located nearby has been completed. For new wells in new formations, these methods do not provide reliable predictions of the formation pore pressure.

SUMMARY OF THE INVENTION

The present invention is at least partly based on the realization that to provide a driller with an early indication of a change in pore pressure gradient it is sufficient to measure formation pore pressure relative to a baseline pressure (such as the bottom hole mud pressure) rather than to measure an absolute pore pressure.

It has also recognised that, when measuring the pore pressure of ultra low permeability (as used herein the phrase "ultra low permeability" refers to less than about $10^{-7}$ Darcy) formations, it is not essential to analyze the formation in situ. This is because, although the pore pressures of detached samples of low permeability formation tend to equalize with the pressure of the surrounding fluid, they do so only relatively slowly.

Thus in general terms the present invention provides a method of monitoring pore pressure comprising analysing downhole in a well a sample of formation (e.g, drill cuttings) to determine the relative pore pressure of the sample.

In a first aspect the present invention provides a method of monitoring pore pressure, comprising the steps of:

(a) providing downhole in a well a sealable container, (b) sealing in the container a sample of fluid at a baseline pressure and a sample of a formation having an initial pore pressure, (c) measuring the change in pressure of the fluid sample, the pressure of the fluid sample and the pore pressure of the formation sample sealed in the container tending to equalize over time, and (d) estimating the initial pore pressure relative to the baseline pressure from the measured change in fluid sample pressure.

The change in pressure of the fluid sample may be is measured as the total pressure change after pressure equalization in the container, as a continuous rate of change of pressure with time, or as discrete pressure measurements at particular times. Whichever way, it is possible to use this information, e.g. by techniques discussed below in the detailed description, to determine the initial pore pressure relative to the baseline or reference pressure of the fluid sample.

For a given formation, the initial pore pressure determined at step (d) can be related to the absolute formation pore pressure at the point where the formation is sampled. Then, by repeating the method for samples retrieved from different positions along the wellbore (and preferably adopting a standardised formation sampling procedure), it is possible to calculate the pore pressure gradient of the formation from the series of corresponding initial pore pressure determinations.

The method can be performed simultaneously with drilling, and the downhole container, therefore, may be mounted on a drill string. Also in one embodiment the formation sample comprises drill cuttings (i.e. the sample retrieval position is the position of the drill bit).

An advantage of this embodiment is that formation pore pressure information at the drill bit can be made available to the driller essentially in real time. The driller can then take appropriate and early action if e.g. there is an indication of a sharp increase in pore pressure.

The fluid sample, which provides the baseline pressure, may comprise drilling mud.

Thus in a preferred embodiment, the formation sample comprises drill cuttings and the sampled fluid is drilling mud. The determination of the initial pore pressure of the formation sample relative to the baseline pressure then provides a direct measure of the degree of overbalance (or underbalance) at the drill bit.

It is desirable that the downhole container is mounted on a drill string adjacent the drill bit. When the formation sample comprises drill cuttings, this arrangement minimizes the exposure of the drill cuttings to drilling mud before they enter the container (so that, at least for low permeability formations, the initial pore pressure of the formation sample is substantially identical to the formation pore pressure immediately ahead of the drill bit). Also, when the sampled fluid is drilling mud, the baseline pressure is then substantially identical to the bottom hole mud pressure at the drill bit.

Preferably the formation permeability is less than $10^{-7}$ Darcy, more preferably less than $10^{-8}$ Darcy, and even more preferably less than $10^{-9}$ Darcy.

The method is not exclusively intended for performance simultaneously with drilling. For example, in one embodiment the sealable container is mounted on a wireline so that the method is performable e.g. during a well logging operation. The formation sample may comprise a cored rock sample, obtained e.g. by a coring tool mounted on the wireline.

This embodiment of the method has an advantage over conventional wireline techniques for estimating formation pore pressure because of its suitability for analysing low permeability rocks. In particular, the relatively high surface area to volume ratio of the detached formation sample increases the rate of pressure equalization in the chamber compared to conventional techniques where a measuring tool is merely moved into engagement with the bulk formation at the wall of the wellbore.

In general, the pressures of the formation and fluid samples will equalize more rapidly in the container, and hence produce at least initially a more significant pressure variation with time of the fluid sample, when the formation sample comprises relatively small rock fragments. Thus, whether the formation sample comprises e.g. drill cuttings or cored rock, the method may comprise a further step of fragmenting the formation sample before step (c).

A further aspect of the present invention provides an apparatus for performing the method of the previous aspect.

For example, such an apparatus may comprise:

(a) a sealable container for deployment downhole in a well into which, when thus-deployed, is sealed a sample of fluid at a baseline pressure and a sample of a formation having an initial pore pressure, (b) a pressure measuring device for measuring the change in pressure with time of the fluid sample sealed in the container, the pressure of the fluid sample and the pore pressure of the formation sample sealed in the container having a tendency to equalize over time, and (c) a processor for estimating the initial pore pressure relative to the baseline pressure from the measured change in fluid sample pressure.

The sealable container may be adapted to be mounted on a drill string or on a wireline.

The apparatus may further comprising a coring tool for obtaining a cored formation sample and/or a fragmenting means for fragmenting the formation sample when the formation sample is in the sealable container.

The processor may comprise e.g. a suitably programmed computer for use at the well surface, the computer receiving remote measurement signals from the pressure measuring device.

BRIEF DESCRIPTION OF THE DRAWINGS

Specific embodiments of the present invention will now be described with reference to the following drawings in which.

DETAILED DESCRIPTION

Figure 1:
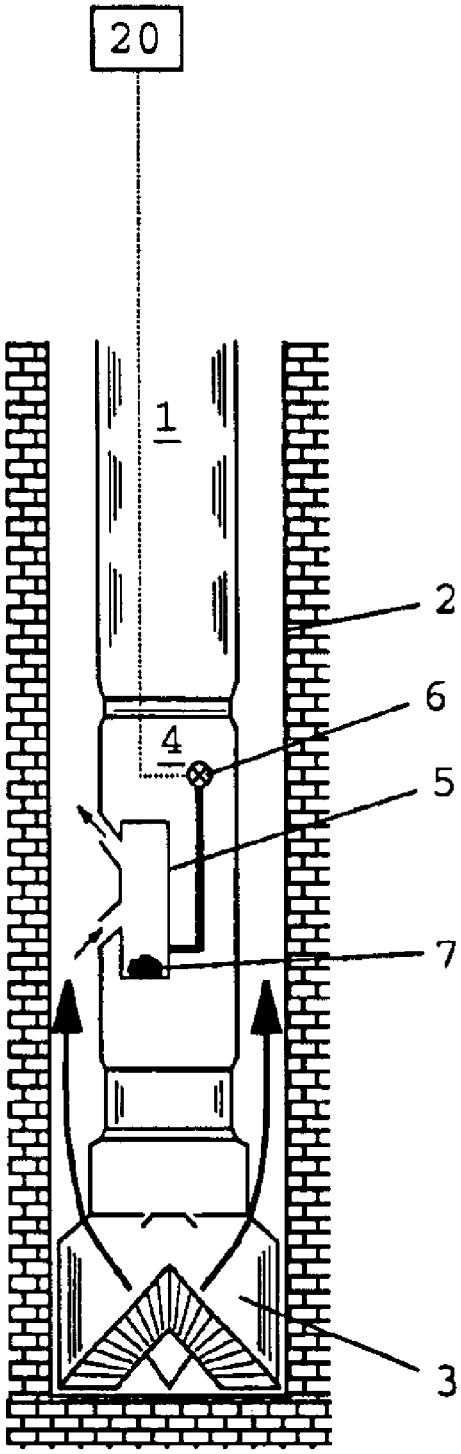
FIG. 1 shows a schematic representation of the bottom hole portion a drill string 1 according to a preferred embodiment of the invention.

A major difficulty associated with the performance of pore pressure measurements on ultra low permeability rock formations concerns the very slow flow of fluid through such formations. This can lead to unacceptably long conventional testing times when direct pore pressure measurements are made on the bulk formation at the wall of the wellbore.

However, pore pressure monitoring according to the method of the present invention can operate on significantly shorter time scales because the pressure measurements can be made on formation samples with relatively high surface area to volume ratios which respond more quickly to changes in external pressure.

In practice, the sample (or components of the sample, if the sample comprises fragments or particles) should preferably be at or close to an optimal size which is large enough substantially to preserve the initial pore pressure during the period between collection of the sample and sealing in the container (when the sample may be exposed to a higher or lower wellbore fluid pressure), but small enough to provide reasonable measurement time scales (clearly the surface area to volume ratio is in inverse proportion to the size of the sample).

Thus although the slow fluid flow through the pores of the formation imposes some constraints on the performance of the method, it also allows formation pore pressures to be monitored using discrete samples, which is convenient from a practical point of view.

The direction of pressure variation inside the container (up or down) allows the immediate determination of the qualitative relationship between the initial pore pressure in the sample and the wellbore pressure.

On the other hand, if pressure equalization between the fluid and formation sample is achieved, and the formation sample porosity, $\phi$, and the volume fraction of the formation sample in the container, $f_s$, are known or can be estimated, the relative initial formation pressure can be simply calculated from the total pressure variation associated with complete pressure equalization.

For example, if the baseline (initial) fluid sample pressure inside the container is $p_m$, the initial pore pressure inside the particles is $p_f$, and the initial pressure difference $\Delta p_o = p_f - p_m$, and we assume for simplicity that the formation pore fluid and surrounding sample fluid are equally compressible and the change in pressure of the fluid inside the pores is not accompanied by variation of the solid matrix volume, then:

$$\Delta p_0 = \frac{1 - f_s + \varphi f_s}{\varphi f_s} \Delta p_f,$$

where $\Delta p_f$ is the pressure build up inside the container at the end of pressure equalization.

It is also possible to estimate the amplitude of the pressure variation of the fluid sample inside the container which would be induced by pressure equalization with the pore pressure of the formation sample.

Substituting the porosity $\phi=0.2$ and the volumetric fraction of cuttings inside the container $f_s=0.3$, the above formula yields $\Delta p_f \approx 0.08 \Delta p_0$.

Since the resolution of typical downhole pressure gauges is of the order $\Delta p=0.1$ psi, a $\Delta p_0 \approx 1.25$ psi should be detectable. Thus in the embodiment where the formation sample comprises drill cuttings and the fluid sample comprises drilling mud, it should be possible to detect an overbalance pressure of the order of a few psi with good accuracy. Indeed, an advantage of this embodiment is that usually a driller does not need to know the formation pressure accurately, only whether it is lower or higher than the downhole mud pressure while drilling. This should justify the simplifications of the above analysis.

Increasing the volume fraction of sampled cuttings inside the container allows one to increase the resolution of detectable overbalance pressure. For example, if $f_s$=0.6, we have the relationship $\Delta p \approx 0.2\Delta p_0$, and for $\Delta p$=0.1 psi we obtain $\Delta p_0 \approx 0.5$ psi.

The length of time required for pressure equalization will depend on: the formation permeability, the sample fluid viscosity, and the unit, particle or fragment size of the sampled formation.

If complete pressure equalization is not achieved, the pressure diffusivity equation (which follows from the Darcy equation for the flow of a slightly compressible formation fluid in a compressible matrix) for the pressure, p, may still be used to determine the relative initial formation pressure from measurements of pressure variation with time. The pressure diffusivity equation provides that:

$$\frac{\partial p}{\partial t} = \eta \nabla^2 p, \quad \eta = \frac{kB}{\mu\varphi},$$

where t is time, $\nabla^2 = \partial^2/\partial x^2 + \partial^2/\partial y^2 + \partial^2/\partial z^2$ is the Laplace operator, and $\eta$ is the pressure diffusivity, which depends on the formation permeability k, the bulk modulus of the formation rock (saturated by fluid) B, the viscosity of the formation fluid $\mu$, and the formation porosity $\phi$.

Thus, as well as measurements of pressure variation with time, parameters which should typically be measured or estimated are $\eta$, $f_s$, the container volume and the sample size (or average size if the sample comprises a plurality of fragments or particles). The pressure diffusivity equation may then be solved by analytical or numerical techniques known to the skilled person to determine the relative initial formation pore pressure.

Clearly, the time required for pressure equalization between the formation sample pore pressure and the fluid sample pressure can have a significant impact on the how the method of the present invention is performed in practice. As mentioned above, the time must be long enough to prevent the pore pressure of the sample from with the surrounding fluid in the interval between extraction of the sample from the formation and sealing of the sample in the container. However, it should be short enough to allow the pressure of the fluid sample sealed in the container with the formation sample to change in a reasonable time scale.

The pressure equalization time can be estimated by applying dimensional analysis to the Darcy equation. This results in the following estimate for the characteristic time of transient pore pressure variation, induced by pressure perturbation at the boundary of a porous particle with a diameter 2d:

$$t_d = \frac{d^2}{\eta} = \frac{d^2 \mu\varphi}{kB}.$$

Using typical values of $d=10^{-3}$ m, $\mu=10^{-3}$ Pa·s, $\phi$=0.2, $k=10^{-9}$ $D=10^{-21}$ $m^2$, and B=1 GPa we find that $t_d$=200 s ≈3 min. Therefore, in a situation with these parameters the formation sample should preferably be sealed in the container within a few tens of seconds, and measurement of the change in pressure of the fluid sample should be completed in a few minutes.

However, because the characteristic time td is proportional to the square of particle size, changing the size of the rock particles or fragments which form the formation sample has a significant effect on td. For example, for particles of size 2 to 3 mm, $t_d$ is of the order of 10 to 30 min. Thus in practice it may be possible to control or optimise the method by varying the formation sample particle size.

The key parameters which can affect the accuracy of the pressure monitoring are: the time to seal the formation sample in the container, the particle or fragment size of the sampled formation, and the volumetric fraction of cuttings inside the container.

In the Appendix analyses are performed to show that, at least for low permeability rock, the impact of (i) near wellbore heat transfer, (ii) formation pore pressure variation caused by drilling, and (iii) stress state around the wellbore should be relatively insignificant and hence should not compromise the method. However, corrections may be required to account for thermally-induced stress and pore pressure variation (analysis of which is also performed in the Appendix). For example, it is estimated that pore pressure changes due to a temperature variation of 10 K may be of the order of 1 MPa. However, formation vertical temperature gradients are generally known or can be measured with reasonable accuracy, so that the amount of e.g. rock cooling caused by the circulating mud and the corresponding reduction in pore pressure can be calculated relatively easily.

A potential difficulty can occur when there is incompatibility between the drilling mud and formation rock leading to chemical reactions and unpredictable volumetric changes in the rock matrix (i.e. swelling or shrinkage). However, even if this happens and a significant contribution to pressure variation inside the container is associated with variation of the sample fluid volume, monitoring the pressure variation in the sealed container should still provide valuable information on the conditions downhole during drilling.

A specific embodiment of the present invention will now be described with reference to FIG. 1, which shows a schematic representation of the bottom hole portion of a drill string 1.

Drill string 1 is situated in a wellbore 2. The bottom hole portion of the drill string has a drill bit 3 and immediately above the drill bit a dismountable pressure monitoring unit 4 comprising a container 5 and a pressure gauge 6 for measuring the pressure in a lower portion of the container. The pressure gauge is operatively connected to a surface computer (20) which processes the pressure measurements taken by the gauge. The large arrows indicate the general direction of drilling mud away flow from the drill bit, and the small arrows indicate the diversion of a portion of that flow into the container.

Figure 2A:
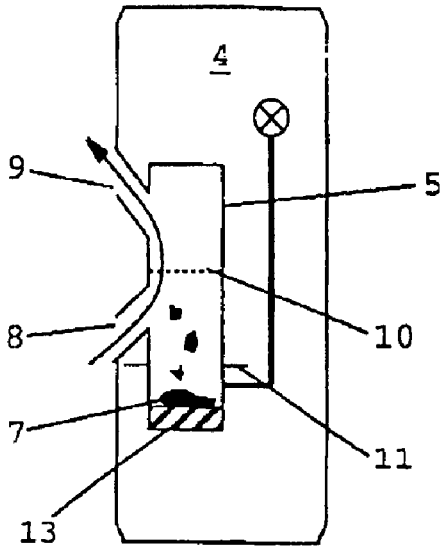
FIGS. 2*a–c* show in more detail the pressure monitoring unit of the drill string of FIG. 1 and illustrate sequential stages in the pore pressure monitoring procedure.
Figure 2B:
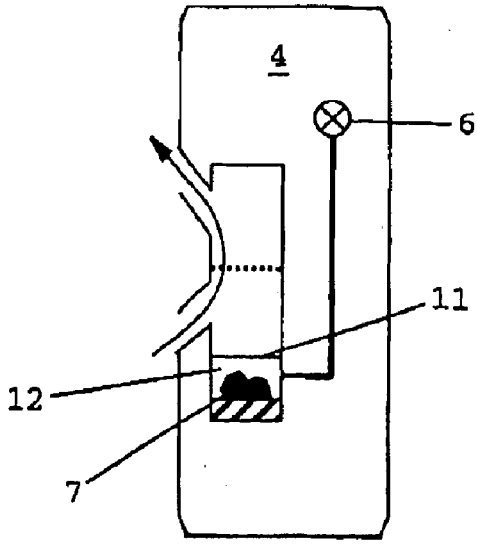
Figure 2C:
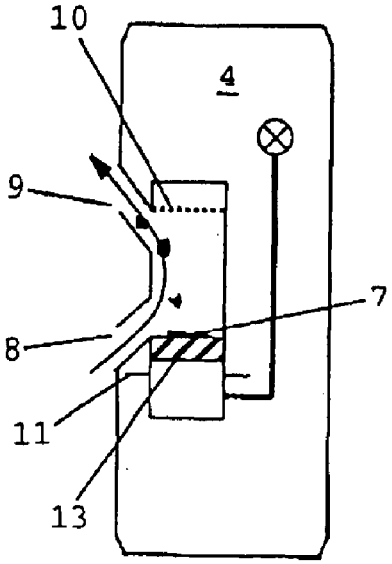

Pressure monitoring unit 4 is shown in more detail in FIGS. 2*a–c* which also illustrate sequential stages in the pore pressure monitoring procedure.

In FIG. 2*a* a sample of drill cuttings is collected in container S. Container 5 has a lower drilling mud inflow port 8 and an upper drilling mud outflow port 9. The arrow indicates schematically the flow of drilling mud through the container via the ports.

Filter 10 is interposed in the container between the ports and prevents a portion of the drill cuttings transported in drilling mud flow from exiting through outflow port 9. This portion sinks through open sealing gate 11 into the lower portion of container 5 and forms drill cuttings sample (i.e. formation sample) 7. The base of the container onto which the cuttings come to rest is formed by the upper face of piston 13.

The next stage is the measurement of the formation sample pore pressure. As shown in FIG. 2*b*, sealing gate 11 is actuated to seal the formation sample and a sample of drilling mud (i.e. fluid sample) 12 in the lower portion of container 5.

Pressure gauge 6 then measures the change in pressure with time of fluid sample 12. The pressure measurements are relayed to the surface computer which processes them to determine the initial pore pressure of the formation sample (i.e. the pore pressure when gate 11 was actuated) relative to the initial (i.e. baseline) pressure of the fluid sample. This may be accomplished e.g. by solving the pressure diffusivity equation (assuming n and d are known or can be estimated reasonably accurately). Because the initial pressure of the fluid sample is essentially identical to the bottom hole mud pressure, this determination provides an indication of the degree of overbalance or underbalance at the drill bit.

Next the formation sample is released as shown in FIG. 2*c*. Gate 11 is opened and piston 13 pushes the formation sample towards inflow port 8. Filter 10 is operatively connected to the piston and is displaced by its movement to a position above outflow port 9. The flow of drilling mud then carries the formation sample out of the container. Subsequently the piston and filter return to their original positions and the pressure monitoring unit is ready to accept another sample of drill cuttings.

Clearly, if the relative initial pore pressure of the formation sample is measured for a series of positions of the drill bit as the wellbore is extended, the driller can then determine the pore pressure gradient in the rock formation at the bottom of the wellbore.

Figure 3:
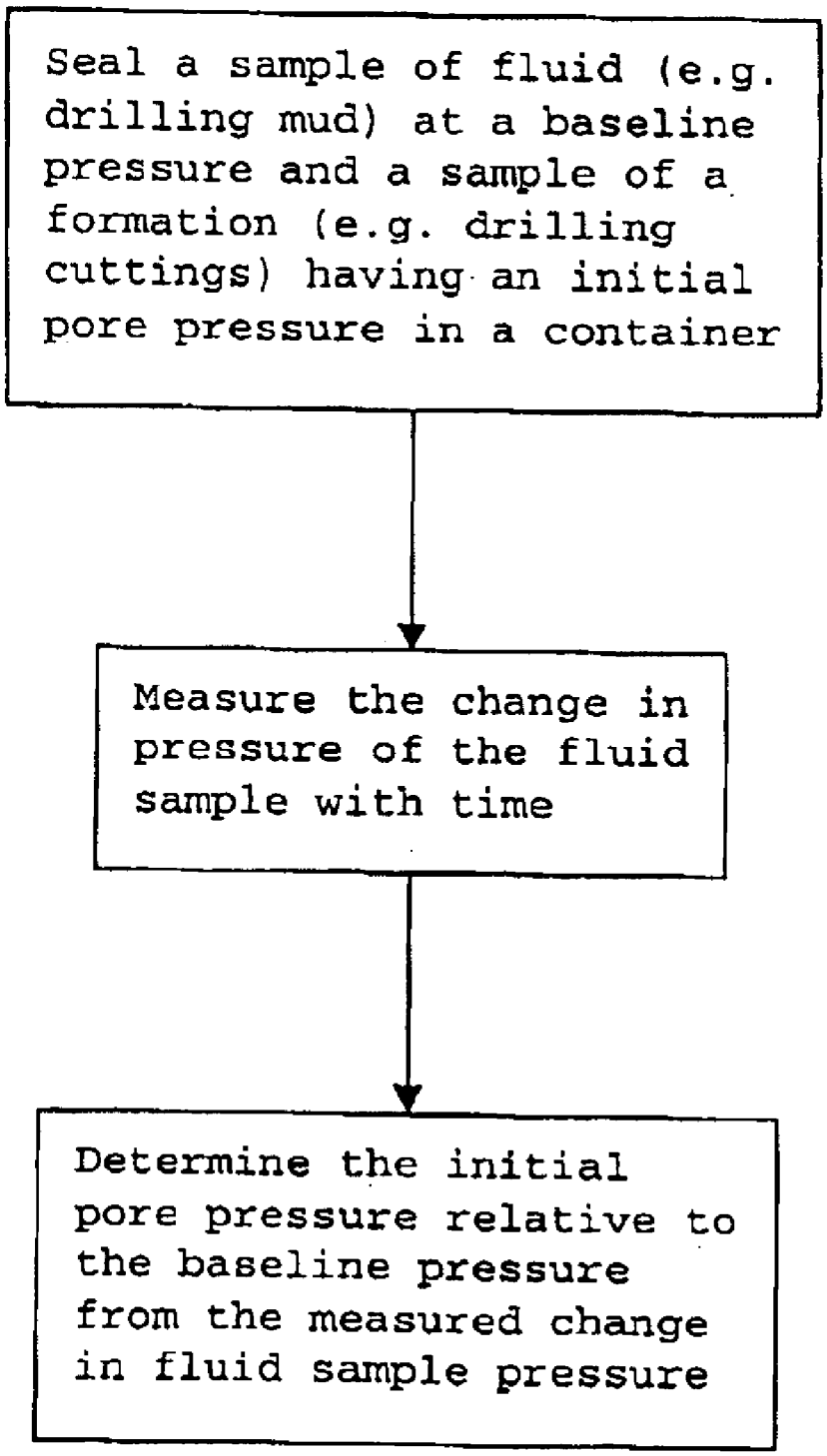
FIG. 3 shows a flowchart describing the method of pore pressure monitoring, according to a preferred embodiment of the invention.

FIG. 3 is a flowchart which shows steps in the method of pore pressure monitoring.

Figure 4:
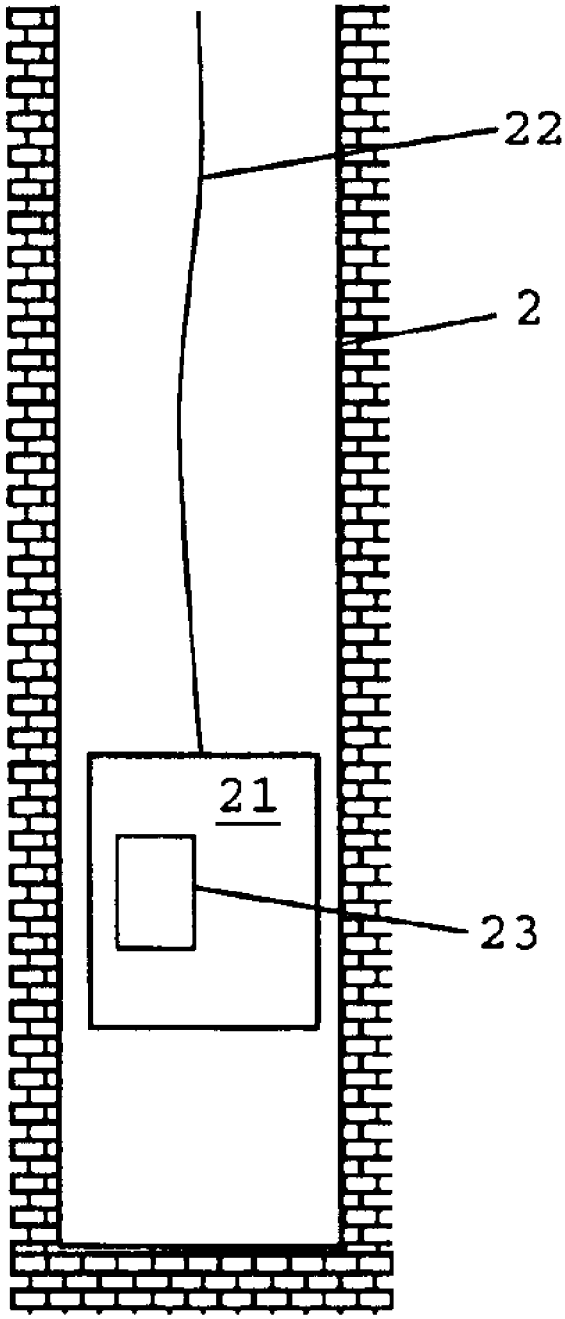
FIG. 4 shows a schematic representation of a wireline coring tool according to an alternative embodiment of the invention.

The concept may also be applied to a coring tool (shown in FIG. 4 as coring tool 21) for deployment in a wellbore from a wireline 22. In use, the tool may drill out a core of diameter of about 1 inch (25.4 mm) and of length of about 2 inches (50.8 mm) from the wall of the wellbore 2. This should allow the remote end of the core to be taken from the zone of formation rock with less perturbed pressure around the wellbore.

The remote end of the core is then detached using fragmenting means 23, sealed in a container with a fluid sample (which may be the ambient wellbore fluid or a dedicated test fluid) having a baseline pressure (e.g. the pressure of the ambient wellbore fluid), and tested according to the methodology shown in the flowchart of FIG. 3.

The tool may have means for crushing the remote end of the core prior to testing in order to produce smaller rock fragments. This would speed up the analysis by accelerating pressure equalization between the formation pore pressure and the fluid sample pressure.

APPENDIX

Analyses of Processes Which May Affect Pore Pressures in Ultra Low Permeability Formations 1. Near Wellbore Heat Transfer Transient temperature variation in reservoir rock in absence of convection is governed by the thermal diffusivity equation $$\frac{\partial T}{\partial t} = \kappa \Delta T, \quad \kappa = \frac{K}{\rho c} \tag{1.1}$$

where K is the thermal conductivity, ρ is the density, C is the specific heat, κ is the thermal diffusivity and ΔT is the Laplacian of the temperature T.

Characteristic values of these parameters for shale and clay, saturated with water, are $$K=2-4\ W/m\cdot K$$

$$\rho=2500\ kg/m^3$$

$$c=0.5-1.5\ kJ/kg\cdot K$$

$$\kappa=(1-1.5)\cdot 10^{-6}\ m^2/s.$$

If the rock is initially at a constant temperature, $T_0$, and then the temperature is instantly elevated up to $T_1>T_0$, a temperature wave will propagate from the boundary into the rock. The characteristic time of heat transfer can be found from dimensional analysis as $$t_{cT}=L^2/\kappa \tag{1.2}$$

where L is the distance from the boundary at elevated temperature.

For L=0.1 m and κ=10 $m^2$/s, one obtains This characteristic time corresponds to the temperature wave propagation into the depth L=0.1 m from the rock surface but the heating of the layer of such a depth may take longer time, depending of the geometry of the problem.

For a linear semi-infinite solid, the solution is $$T - T_0 = (T_1 - T_0)\mathrm{erf}\left\{\frac{x}{2\sqrt{\kappa t}}\right\} \tag{1.4}$$

where x is the distance from the boundary.

For the radial problem (wellbore with radius $r_w$), the solution is given in [1] (p. 335 and FIG. 41 on p. 337). For example, the temperature reaches 0.3ΔT, 0.5 ΔT and 0.6 ΔT at $t/t_{cT}\approx 1$, 3 and 10 respectively, where $t_{cT}=r_w^2/\kappa$.

2. Pore Pressure Variation Near Wellbore While Drilling

The maintained overbalance pressure and the filter cake deposition at the wellbore surface affect the pore pressure behaviour around the wellbore during drilling. For low permeability rock like shale, the filter cake is usually of a poor quality and the leak-off is controlled by the hydraulic conductivity of rock. In this case, the transient pressure behaviour is governed by the pressure diffusivity equation $$\frac{\partial p}{\partial t} = \eta \Delta T, \quad \eta = \frac{kB}{\phi \mu} \tag{2.1}$$

where k is the permeability, B is the bulk modulus of the rock saturated with fluid, ϕ is the porosity, $\mu$ is the fluid viscosity and η is the pressure diffusivity.

The characteristic time of pore pressure variation is $$t_{cp}=L^2/\eta \tag{2.2}$$

where L is the characteristic scale.

Let us estimate $t_{cp}$, using the following data:

$$k=1\ nD=10^{-21}\ m^2$$

$$B=1\ GPa$$

$$\phi=0.2$$

$$\mu=1\ cp=1\ mPa\cdot s.$$

For L=0.1 m, one has $$t_{cp}=2\cdot 10^6\ \mathrm{s} \approx 23\ \mathrm{days} \tag{2.3}$$

This example shows that, for normal drilling operations, the pore pressure around the wellbore at the distance of 10 cm should be close to the formation pressure even after a few days of the exposure of the wellbore surface to the overbalance pressure.

3. Stress State Around Wellbore

It is assumed that the rock behaves as a pure elastic solid and (due to its very low permeability) variation of its stress state is not accompanied by fluid flow. We would like to estimate the pore pressure variation near the wellbore under undrained conditions induced by the unloading of the surrounding rock as a result of drilling. It is also assumed that that the wellbore is vertical and its axis is parallel to the principal stress, $\sigma_z=\sigma_v$, whereas two other principal stresses, $\sigma_x=\sigma_{H1}$ and $\sigma_y=\sigma_{H2}$, are horizontal, i.e. they are perpendicular to the wellbore axis.

The effective stresses, $\sigma_t'=\sigma_t-P_o$, induced around the instantaneously created wellbore, are given by the formulae (see [2], p. 116)

$$\sigma_r' = \left(\frac{\sigma_{H1}'+\sigma_{H2}'}{2}\right)\left(1-\frac{r_w^2}{r^2}\right) + \left(\frac{\sigma_{H1}'-\sigma_{H2}'}{2}\right)\left(1+\frac{3r_w^4}{r^4}-\frac{4r_w^2}{r^2}\right)\cos 2\theta + \Delta p\frac{r_w^2}{r^2} \tag{3.1}$$

$$\sigma_\theta' = \left(\frac{\sigma_{H1}'+\sigma_{H2}'}{2}\right)\left(1+\frac{r_w^2}{r^2}\right) - \left(\frac{\sigma_{H1}'-\sigma_{H2}'}{2}\right)\left(1+\frac{3r_w^4}{r^4}\right)\cos 2\theta - \Delta p\frac{r_w^2}{r^2} \tag{3.2}$$

$$\sigma_z' = \sigma_V - v\left[2(\sigma_{H1}-\sigma_{H2})\frac{r_w^2}{r^2}\cos 2\theta\right] \tag{3.3}$$

where the angle $\theta$ is measured from the axis OX in the horizontal plane, v is the Poisson ration, and $\Delta_P=P_w-P_0$ is the instantaneously applied overbalance pressure.

Let us estimate the variation of the mean effective stress in the rock $$\sigma' = \frac{1}{3}(\sigma_r'+\sigma_\theta'+\sigma_z') \tag{3.4}$$

induced by drilling.

Its reference value corresponds to the in situ stresses in intact rock and therefore one has $$\sigma_0' = \frac{1}{3}(\sigma_v'+\sigma_{H1}'+\sigma_{H2}') \tag{3.5}$$

The minimal and maximal mean stresses are achieved at $\theta=0$ and $\theta=\pi/2$ respectively. Using (3.1)–(3.3), we arrive at the formulae $$\sigma_{\min}' = \frac{1}{3}[(3+2v)\sigma_{H2}'-(1+2v)\sigma_{H1}'+\sigma_V'] \tag{3.6}$$

$$\sigma_{\max}' = \frac{1}{3}[(3+2v)\sigma_{H1}'-(1+2v)\sigma_{H2}'+\sigma_V'] \tag{3.7}$$

Subtracting (3.5) from (3.6) and (3.7), we obtain $$\Delta\sigma = \Delta\sigma'|_{\theta=0} = -\Delta\sigma'|_{\theta=\pi/2} = \frac{2(1+v)}{3}(\sigma_{H1}'-\sigma_{H2}') = \frac{2(1+v)}{3}(\sigma_{H1}-\sigma_{H2}) \tag{3.8}$$

An interesting observation is that $\Delta\sigma'$ does not depend on the initial pore pressure and the applied overbalance but only on the initial contrast in horizontal stresses.

Example. The depth of formation is 3000 m, $\sigma_v$=75 MPa, $\sigma_{H1}=0.8\sigma_v$, $\sigma_{H2}=0.7\sigma_v$, v=0.25, E=10 GPa.

Using (3.8), we find that $$\Delta\sigma \approx 0.8\times 0.1\times 75 = 6\ MPa \tag{3.9}$$

The volumetric strain, $\Delta\epsilon$, induced by the mean stress variation can be estimated as $$\Delta\varepsilon = \frac{3(1-2v)}{E}\Delta\sigma \tag{3.10}$$

and therefore $\Delta\epsilon\approx 10^{-3}$, i.e. it is of the order of 0.1%.

Assuming that this volumetric strain is translated into the variation of the rock porosity, $\Delta\phi=\phi\Delta\epsilon$, the pore pressure variation can be estimated, induced by the variation of the mean stress, as $$\Delta p = \frac{\Delta V_f}{V_f}B_f \approx \phi\Delta\varepsilon B_f \tag{3.11}$$

where $V_f$ is the fluid volume and $B_f$ is the bulk modulus of the formation fluid.

Substituting in (3.11) $B_f$=1 GPa and $\phi$=0.2, we obtain $$\Delta p \approx 0.2\ MPa \tag{3.12}$$

Thus the pore pressure variation is estimated at the wellbore, induced by the mean stress variation. At a distance of one wellbore radius from the wellbore wall, the induced pore pressure variation will be smaller.

4. Thermally-Induced Stress and Pore Pressure Variation

Let us estimate the pore pressure build-up due to increase in temperature $\Delta T$, induced by the heat exchange between the mud and the rock during drilling. To simplify the task, we will neglect the fluid flow effects and uncouple the thermal effects and the stress state variation induced by creation of the wellbore.

The volumetric stain, induced by the temperature variation in the rock matrix, can be estimated as $$\Delta\epsilon_T = \beta\Delta T \tag{4.1}$$

where $\beta=3\alpha$ is the coefficient of thermal expansion and a is the coefficient of linear expansion.

For shale, $\alpha=(1-1.5)\times 10^{-5}$ K-$^{-1}$. If $\Delta T$=100K then for $\alpha=10^{-5}$ $K^{-1}$ we have $$\Delta\epsilon_T \approx 3\times 10^{-5}\times 100 = 3\times 10^{-3} \tag{4.2}$$

This volumetric strain should be translated into the porosity variation of the order of 0.3%, i.e.

$$\Delta\phi_T = \phi\Delta\epsilon_T \approx 3\times 10^{-3}\phi \tag{4.3}$$

At the same time, the temperature variation should be accompanied by the expansion of the pore fluid, which can be estimated as $$\frac{\Delta V_f}{V_f} = \beta_f\Delta T \tag{4.4}$$

where $\beta_f$ is the coefficient of thermal expansion for the fluid, i.e. oil or water.

The coefficient of thermal expansion for water, $\beta_W$, depends on temperature and pressure. At atmospheric pressure and at a temperature between 5° C. and 80° C., we have $$\beta_W = (0.5-6.0)\times 10^{-4} K^{-1} \tag{4.5}$$

The coefficient of thermal expansion for oil is probably about 1.5 times higher.

Substituting in (4.4) $\Delta T$=100 K and $\beta_f=10^{-4}$ $K^{-1}$ (a reasonable estimate for water at high pore pressure), we obtain $$\frac{\Delta V_f}{V_f} = 10^{-4} \times 100 = 10^{-2} \tag{4.6}$$

and therefore for oil we may have $$\frac{\Delta V_f}{V_f} = 1.5 \times 10^{-2} \tag{4.7}$$

Since fluid expansion is partially compensated by the increase in porosity, the actual increase in the fluid volume, which should be compensated by the pore pressure variation, is $$\frac{\Delta\phi}{\phi} = \frac{\Delta V_f}{V_f} - \frac{\Delta\phi_T}{\phi} \approx 10^{-2} \tag{4.8}$$

The corresponding increase in the pore pressure can be estimated as $$\Delta p|_{\Delta T=100} = \frac{\Delta V_{fT}}{V_f} B_f = 10^{-2} \times 1 \text{ GPa} = 10 \text{ MPa} \tag{4.9}$$

So the average pressure perturbation due to rock heating is of the order of 1 MPa for each 10 K of temperature variation, i.e. thermal effects on the pore pressure due to drilling seem to be predominant.

REFERENCES

1. H. S. Carslaw & J. C. Jarger: Conduction of Heat in Solids,
2. E. Fjaer, R. M. Holt, P. Horsrud, A. M. Raaen and R. Risnes: Petroleum Related Rock Mechanics, Development in Petroleum Science, Vol. 33, Elsevier, 1992.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A method of monitoring pore pressure, comprising the steps of:

(a) providing downhole in a well a sealable container, (b) sealing in the container a sample of fluid at a baseline pressure and a sample of a formation having an initial pore pressure, (c) measuring a change in pressure of the fluid sample, the pressure of the fluid sample and the pore pressure of the formation sample sealed in the container tending to equalize over time, and (d) estimating the initial pore pressure relative to the baseline pressure from the measured change in fluid sample pressure.

2. A method of monitoring pore pressure according to claim 1, wherein the formation sample comprises drill cuttings.

3. A method of monitoring pore pressure according to claim 1, wherein the formation sample comprises a cored rock sample.

4. A method of monitoring pore pressure according to claim 1, wherein the fluid sample comprises drilling mud.

5. A method of monitoring pore pressure according to claim 1, wherein the downhole container is mounted on a drill string.

6. A method of monitoring pore pressure according to claim 5, wherein the container is adjacent the drill bit.

7. A method of monitoring pore pressure according to claim 1, wherein the downhole container is mounted on a wireline.

8. A method of monitoring pore pressure according to claim 1, wherein the formation permeability is less than $10^{-7}$ Darcy.

9. A method of monitoring pore pressure according to claim 1, comprising the further step of fragmenting the formation sample before step (c).

10. A method of monitoring the pore pressure gradient of a formation comprising estimating, for each of a plurality of positions in the formation, a relative formation pore pressure and calculating the pore pressure gradient therefrom, each relative formation pore pressure being the initial pore pressure determined by performing the method of claim 1.

11. An apparatus for monitoring pore pressure, comprising:

(a) a sealable container for deployment downhole in a well into which, when thus-deployed, is sealed a sample of fluid at a baseline pressure and a sample of a formation having an initial pore pressure, (b) a pressure measuring device for measuring a change in pressure of the fluid sample sealed in the container, the pressure of the fluid sample and the pore pressure of the formation sample sealed in the container having a tendency to equalize over time, and (c) a processor for estimating the initial pore pressure relative to the baseline pressure from the measured change in fluid sample pressure.

12. An apparatus for monitoring pore pressure according to claim 11, wherein the scalable container is adapted to be mounted on a drill string.

13. An apparatus for monitoring pore pressure according to claim 11, wherein the sealable container is adapted to be mounted on a wireline.

14. An apparatus for monitoring pore pressure according to claim 11, further comprising a coring tool for obtaining a cored formation sample.

15. An apparatus for monitoring pore pressure according to claim 11, further comprising a fragmenting means for fragmenting the formation sample when the formation sample is in the sealable container.

* * * * *